US006774292B2

(12) United States Patent
Mace

(10) Patent No.: US 6,774,292 B2
(45) Date of Patent: Aug. 10, 2004

(54) GRAPHITE/CARBON FIBER AND WOOD NECK FOR A STRINGED MUSICAL INSTRUMENT USING FORCE VECTOR CONTROLLED GEOMETRY

(76) Inventor: Lynn Ray Mace, 54 Roy Hollifield Rd., Marion, NC (US) 28752

( * ) Notice: Subject to any disclaimer, the term of this patent is extended or adjusted under 35 U.S.C. 154(b) by 272 days.

(21) Appl. No.: 10/086,226

(22) Filed: Feb. 28, 2002

(65) Prior Publication Data

US 2002/0174760 A1 Nov. 28, 2002

Related U.S. Application Data

(60) Provisional application No. 60/278,985, filed on Mar. 28, 2001.

(51) Int. Cl.[7] ..... G10D 3/00
(52) U.S. Cl. ..... 84/293
(58) Field of Search ..... 84/293, 290, 267, 84/291, 292

(56) References Cited

U.S. PATENT DOCUMENTS 4,681,009 A * 7/1987 Mouradian ..... 84/293
4,951,542 A * 8/1990 Chen ..... 84/293
5,337,644 A * 8/1994 Fishman et al. ..... 84/267
5,616,873 A * 4/1997 Fishman et al. ..... 84/293
6,100,458 A * 8/2000 Carrington et al. ..... 84/267

* cited by examiner

*Primary Examiner*—Kim Lockett

(57) ABSTRACT

A stringed musical instrument, which has a neck assembly, a body, and a plurality of strings. The neck assembly having a structure made of wood and composite materials of graphite/carbon fiber, and epoxy resins. Which is of sufficient strength and stiffness to withstand, without deformation, the entire load imposed upon the neck assembly by the tension of the strings. The neck assembly will include one structural load bearing wooden core, laminated with the composite external skin structure and epoxy resins, and will extend completely along the length of the neck assembly. The use of wood as a core structural material will enable the instrument to retain the response and tonal qualities of stringed instruments, which is common to a traditional wooden neck assembly. A fingerboard of wood is bonded to the composite external structure and a non-structural, non-load bearing two way string orbit relief adjustment mechanism is installed in the node region along the longitudinal axis of said neck assembly.

4 Claims, 7 Drawing Sheets

GRAPHITE/CARBON FIBER AND WOOD NECK FOR A STRINGED MUSICAL INSTRUMENT USING FORCE VECTOR CONTROLLED GEOMETRY

This application claims the benefit of Provisional application 60/278,985 filed Mar. 28, 2001

BACKGROUND OF THE INVENTION

Field of Invention

This invention relates to a stringed musical instrument and in particular to instrument components such as the neck and central body structure.

A few guitar builders and manufacturers have used carbon fiber with varying degrees of success. One such prior art design (U.S. Pat. No. 5,990,396) has a central T-shaped extruded stiffening bar preferably of graphite fibers which, alone, carries the load imposed by a plurality of strings, and the wood is not a structural element thereof. One other prior art design (U.S. Pat. No. 5,616,873) uses a fingerboard made of graphite fibers in the place of the traditional prior art fingerboard. This serves as the main structural element while using a wire to counteract the tension load imposed by a plurality of strings similar to another prior art design (U.S. Pat. No. 4,074,606). It specifies a soft wood, and the wood is not a structural element. Another prior art design (U.S. Pat. No. 4,951,542) using graphite, however, this patent pertains to the molding process, and does not relate to an engineered design, nor does it specify any particular orientation of the graphite fibers, also heat and pressure are used. One other prior art design (U.S. Pat. No. 6,087,568) using a graphite and glass composite to cast a complete neck assembly, of which wood is not a structural element.

Graphite, or carbon fiber (one and the same) is only rayon extruded under extreme heat and pressure. This changes its molecular structure on a subatomic level. It is a material that lends itself to highly engineered applications with its high strength and stiffness coefficient (it is six times stronger than chrome-moly steel). It is a composite material that offers excellent values of strength in compression as well as tension.

In order to capitalize on this attribute the structure must be designed, and the workmanship must be of such quality, so as to apply the fibers in a perfectly straight line with reference to the load being placed on it, carried by it, and distributed into other structures. When this is achieved, a minimal amount of graphite can be used. (The preferred embodiment of the invention uses approximately 60 cubic centimeters of material.)

Also, the magnitude of engineering should be considered. Many factors weigh into a design of this type. Such as string tension values, displaced tension fields, semi-tension fields, column loads, and load terminations, etc.

On the other hand arbitrary over use of graphite will produce a neck that will not resonate the desired tone, and be so stiff that any string orbit relief is impossible. The choice of a matrix strong enough to capture this material is paramount.

A true "composite" structure must be engineered and designed as a whole. This one is constructed from carbon fiber and wood. In the preferred embodiment it should be manufactured by hand, and not be extruded or mass produced, and it requires very skilled labor.

Some prior art designs place a number of small graphite rods in the node region of the structure (Center of Neck).

This area is where the structure yields, or flexes the absolute least. In order to utilize this material best, and achieve a good strength to weight ratio the structural element (graphite) must be placed as far away from the node region as possible.

This instruments neck design is of composite sandwich/stressed skin truss type. It utilizes a high-density wooden core to bear against. From an engineering standpoint the wood's primary function is as an inter-laminar sheer and compression core. Which holds the graphite in its proper place so that it functions as designed, and transfers opposing loads in a semi-tension field from one point to another, and to withstand the crush loads imposed in the region between the compression spar and the tension spar.

From a musical standpoint the wood needs only to resonate the desired tone. It is still a crucial element to the structure.

BRIEF SUMMARY OF THE INVENTION

A composite structure, engineered using force vector controlled geometry, constructed around a high density structural wood core with an outer stressed skin truss structure made of carbon fiber cloth and epoxy resins, and containing therein compression and tension spar caps made of graphite.

I believe this is the first embodiment of this type technology applied to a stringed musical instrument, and with proper application of these materials there is little change in the relative mass to density ratio of the original wood. Therefore, tone and the natural resonance of the wood are preserved as much as possible, while tremendous gains in strength, stiffness, and stability are achieved.

Preliminary tests of the invention reveal that it is at least twelve times stiffer than a conventionally constructed (prior art) wooden neck. It has very little thermal creep and distortion in comparison to a (prior art) wooden neck, and although subjective, the tonal differences are insignificant.

DETAILED DESCRIPTION OF THE INVENTION

Figure 1:
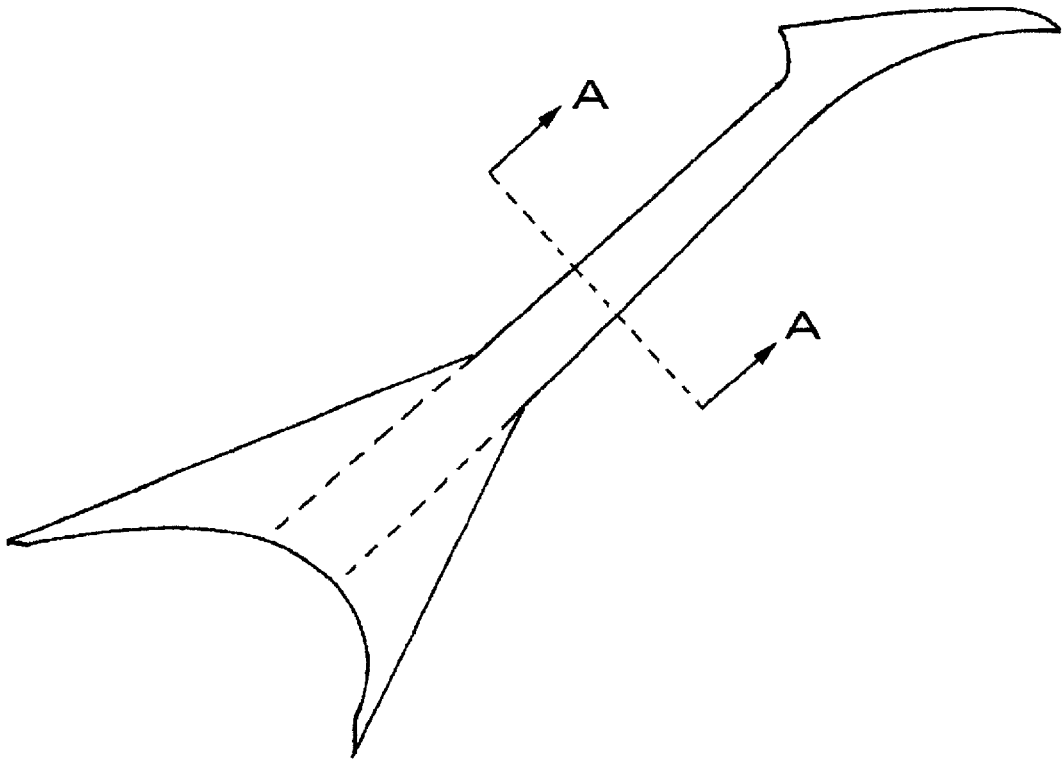
FIG. 1 is a perspective view of the stringed instrument in accordance with the invention.
Figure 2:
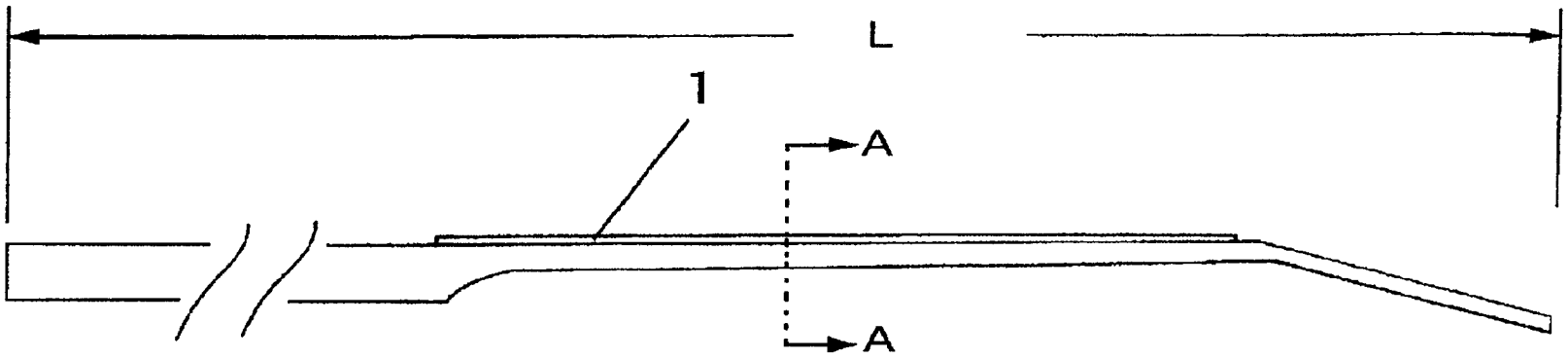
FIG. 2 is a side view of the composite structure of the neck assembly in accordance with the invention.
Figure 6:
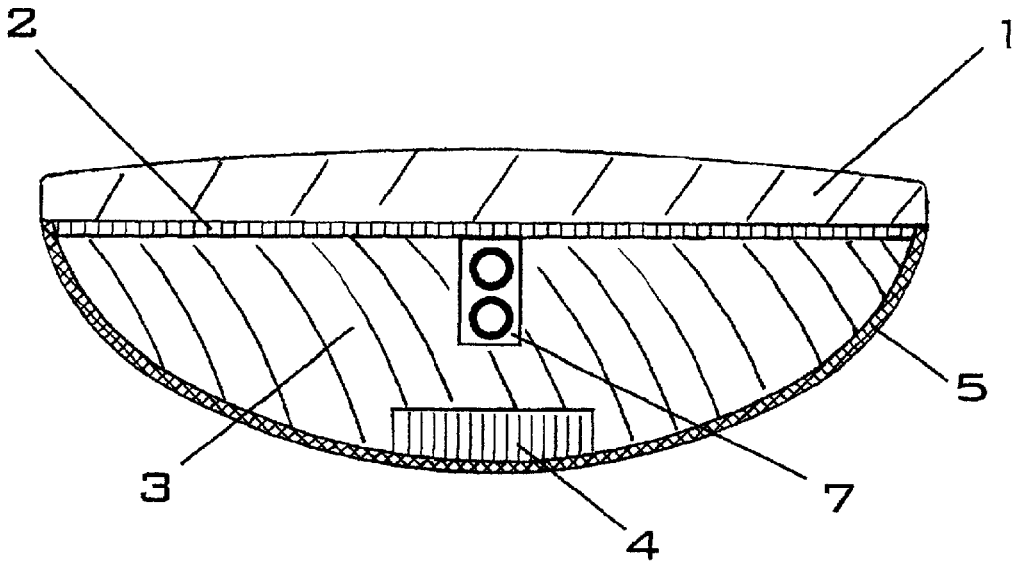
FIG. 6 is a cross sectional end view of the complete structure of the neck assembly taken along line A—A of FIG. 1.
Figure 7:
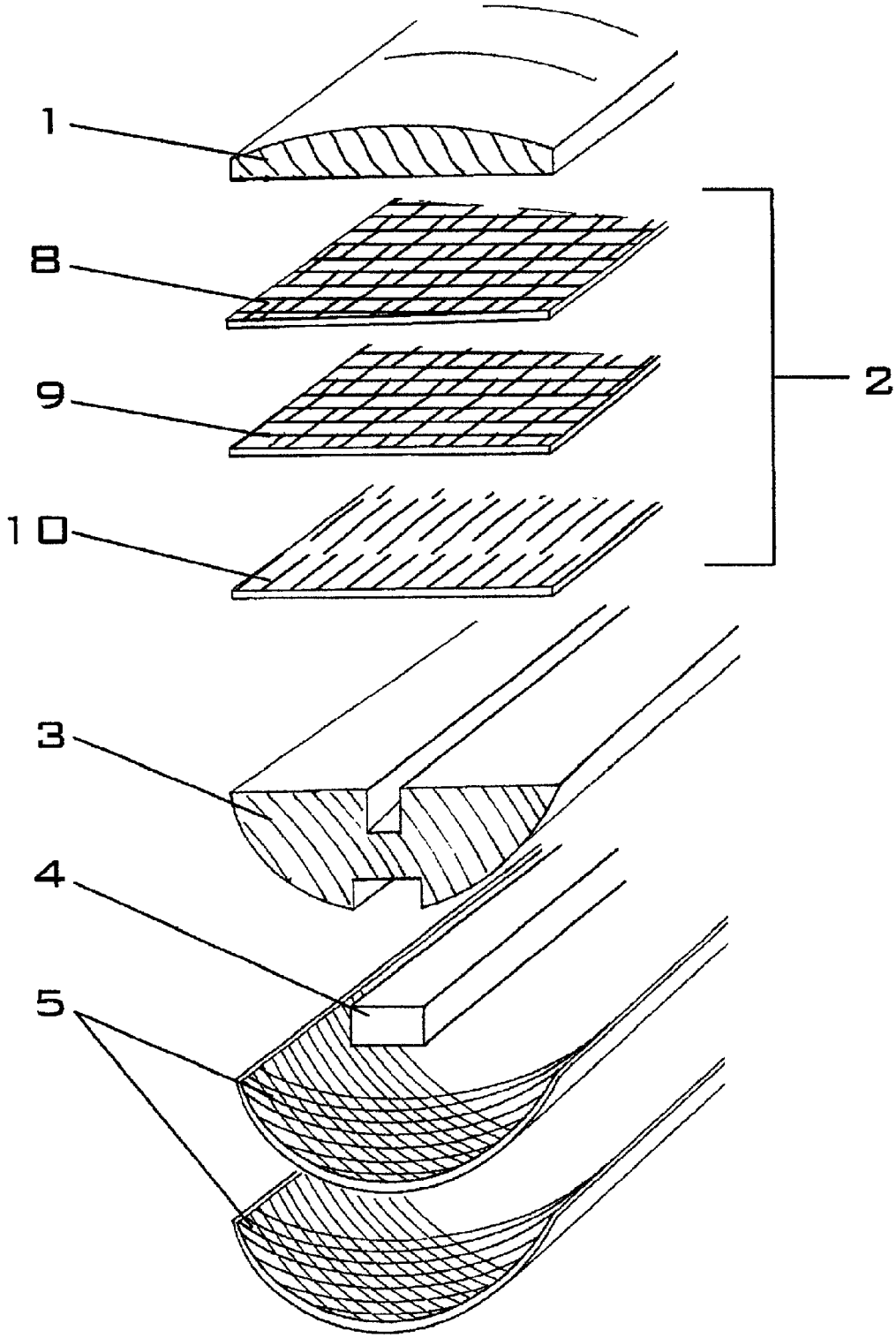
FIG. 7 is an exploded perspective view of the individual components of the neck assembly structure taken along line A—A of FIG. 1.

A: Referring to FIG. 1 a guitar constructed in accordance with the present invention has a neck and central body portion extending along L (shown in FIG. 2) with a wood core 3 (shown in FIGS. 4,5,6,7) of hard maple or mahogany with a specific gravity not less than 0.36, a grain run out of not more than one in 15, and at least six annular rings per inch. Machined to the desired semicircular cross-sectional shape FIG. 6 common to the back of a (prior art) wooden neck, and undersized on all applicable surfaces approximately 0.032 inches to accommodate the required thickness of graphite/carbon fiber cloth and resin 2 and 5 (Shown in FIGS. 4,5,6,7).

Figure 3:
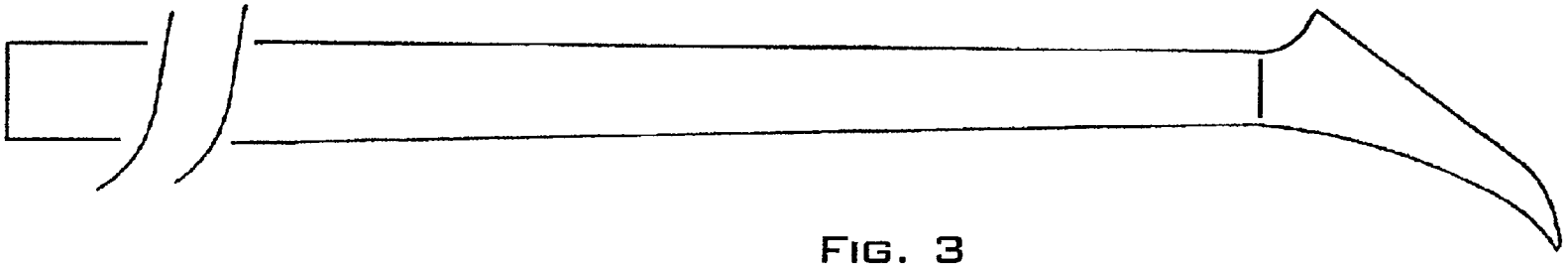
FIG. 3 is a top view of the composite structure of the neck assembly in accordance with the invention.
Figure 4:
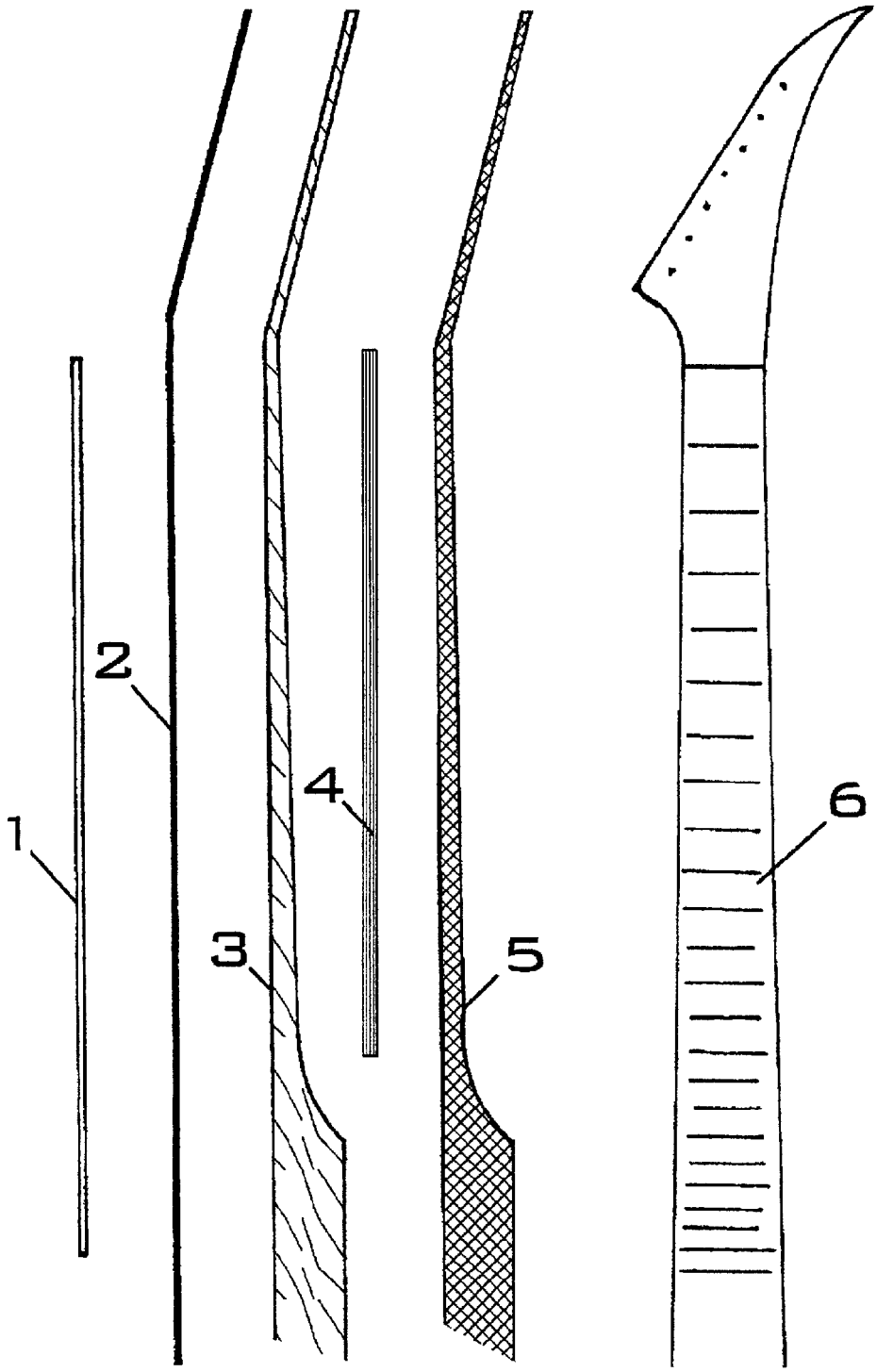
FIG. 4 is an exploded side view of the structure of the neck assembly taken along line A—A of FIG. 1 with item 6 being a frontal view of same
Figure 5:
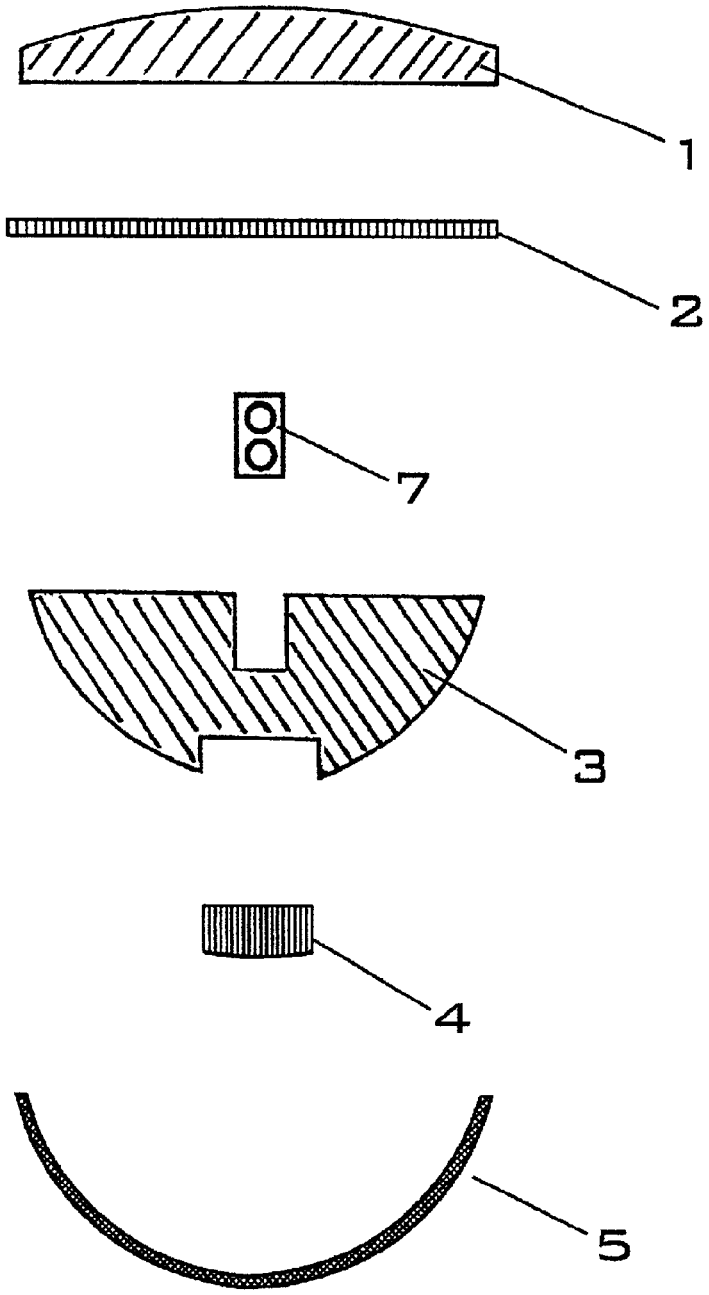
FIG. 5 is an exploded cross sectional view of the structure of the neck assembly taken along line A—A of FIG. 1.

B: On the face of the neck FIG. 3 between the traditional (prior art) wood fingerboard 1 (shown in FIGS. 2,4,5,6,7) and the semicircular section described in "A" a carbon/graphite compression spar 2 (shown in FIGS. 4,5,6,7) is constructed (for string tension values between 55 and 85 total lbs.) Using one ribbon of Uni-Directional Aerospace grade graphite 10 (shown in FIG. 7) 0.012 inch thick, and two layers of aerospace grade AS282 8 and 9 (shown in FIG. 7) or equivalent. It is laminated using Gougeon Brothers/West System™ Slow 105–206 laminating resin or equivalent (fast set resins are not permitted as they do not allow sufficient wick time to properly lock up the fibers). For string tension values above 85 lbs., but not to exceed 150 lbs., two layers of Uni-Directional Aerospace grade graphite ribbon totaling 0.024 inches thick shall be used in conjunction with two layers of AS282 or equivalent as prescribed in this paragraph.

C: On the side opposite the compression spar 2 (shown in FIGS. 4,5,6,7) at the centerline of the semicircular section described in "A" a tension spar 4 (shown in FIGS. 4,5,6,7) shall be installed and bonded (for string tension values between 55 and 85 total lbs.) The tension spar 4 shall be 0.125 by 0.375 inches and at least 17 inches in length. It will be fabricated with only Uni-Directional graphite. For string tension values above 85 lbs., but not to exceed 150 lbs., the cross-sectional area of the tension spar 4 shall be 150% of the previously described dimensions and at least 17 inches in length.

D: At this point the tension spar 4 (shown in FIGS. 4,5,6,7) is fared into the semicircular structural wood core 3. Then two layers of AS282 Bi-Directional 5 (shown in FIGS. 4,5,6,7) are placed on the outer portion of the back of the wood core 3 the fibers are oriented at 45° to the centerline of the longitudinal axis of the neck wooden core 3, and laminated with the resin described in "B". This stressed skin 5 (shown in FIGS. 4,5,6,7) serves to provide a torsional rigidity about the entire structure, and to pick up semi-tension loads from the tension spar 4 along with the active crush loads generated in the region between the compression spar 2 and the tension spar 4 and redistribute said loads into the 45° fibers of the outer skin structure 5 as a counteracting force upon the compression spar 2 (This is Force Vector Controlled Geometry).

E. A 0.225-inch slot will be machined into the center of the compression spar 2 and wooden core 3 at a depth to accommodate the string orbit relief control mechanism 7 (shown in FIGS. 5,6), but not excessively into the underlying tension spar 4 (a maximum cut into the tension spar of 0.020 inches is allowed). This mechanism 7 is necessitated by the design which is so stiff that if the player desires string orbit relief it must be put in by turning the adjuster mechanism 7 in a counterclockwise direction, not taken out as is common with traditional (prior art) wooden neck designs.

F. The adjustment mechanism 7 shall be installed and the (prior art) fingerboard 1 of desired wood shall be bonded to the compression spar 2 outer surface using 3M Scotch-Weld™ adhesive or equivalent. Using clamps and a suitable fixture so as to maintain surface straightness of the (prior art) fingerboard 1 within +0.003 inches.

G. The scored peel-ply finish may be sanded lightly, but not excessively. The carbon/graphite outer skin 5 shall not be cut into by means of sanding, as this weakens the structure. The carbon/graphite exterior shall be finished with a high solids clear such as PPG Diamond Coat™ or equivalent. Containing UV blocking compounds with a maximum of four applied coats. (An aesthetic benefit is an attractive "snake-skin" type appearance.) Mass production high build FeatherFill™ type primers/surfacers are not permitted on the neck as they alter and deaden the tone of the underlying wood.

Figure 8:
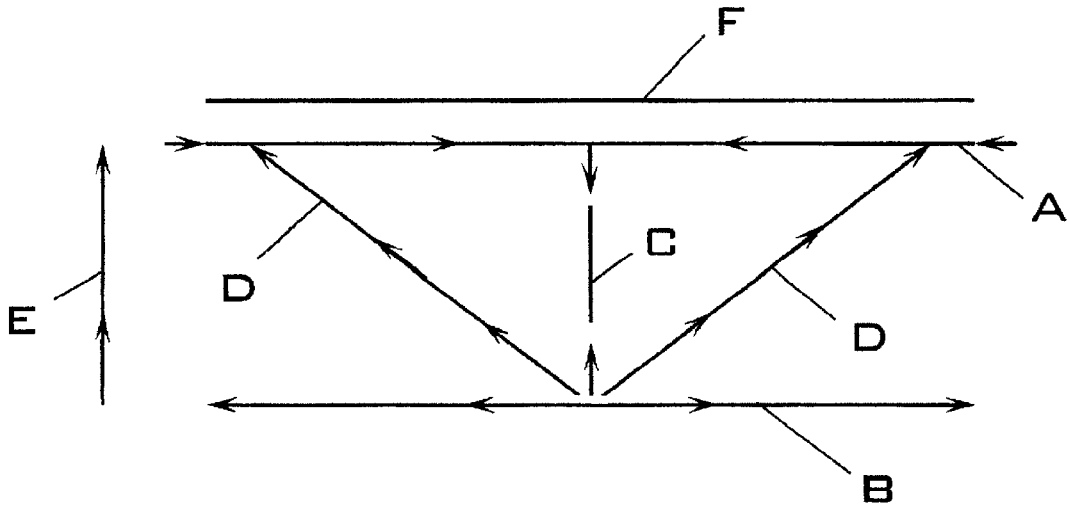
FIG. 8 is a geometric force vector diagram with reference to the engineering of the invention.

H. FIG. 8 is a geometric force vector flow diagram illustrating the loads imposed by the plurality of strings F and the resulting radial load E on the entire structure, and how the design of this invention redistributes said loads. The individual loads and vectors created by string tension are: compression load A carried by 2 (FIGS. 4,5,6,7), a semi-tension load B carried by 4 (FIGS. 4,5,6,7), a crush load C generated by the opposing forces of A and B and carried by 3 (FIGS. 4,5,6,7), and distributed into the outer skin truss 5 (FIGS. 4,5,6,7), with D representing the redirection of loads A, B, and C as opposing forces to the original compression load A.

Notes

1. With reference to the longitudinal centerline of the structure all graphite and carbon fiber 2, 4, and 5 (shown in FIGS. 4,5,6) 4, 5, 8, 9, and 10 (shown in FIG. 7), shall be oriented at right angles, parallel, or at 45°±5° no other deviations are acceptable.

2. Steps "C" and "D" shall be accomplished with the neck being held in or upon a fixture which maintains absolute straightness in the plane where the (prior art) fingerboard 1 attaches to the compression spar 2 within a tolerance of ±0.002 inches. It shall be held here for a minimum of 72 hours from the time of the application of the resin (described in material specification section appendixes A).

3. A peel-ply may be used. Heat or acceleration is not permitted. The temperature of the lay up shall be maintained between 70° F. and 100° F. for the duration of the 72 hours. Pre-pregs and/or autoclave shall not be permitted as the heat process will affect the moisture content of the wood core, causing it to steam out into the resin matrix during curing later contributing to delamination.

4. This design has been engineered to provide a minimal alteration in the mass to density ratio of the wooden structure, with maximum stiffness, minimal thermal creep, and excellent preservation of the wood tone and resonance. The preferred embodiment of the invention employs approximately 60 cubic centimeters of total material in a typical six-string 25.5 inch scale guitar neck.

Appendix A

Material Specifications

1: Carbon fiber cloth Aerospace grade AS282 BID, manufactured by Hexel Chemical Corporation, plain weave 12.5×12.5, 5.7 oz.

2: Uni-Directional graphite tape Aerospace grade 0.012 inch thick, 54,000 lbs. strength per inch of width.

3: 0.125×0.375×17-inch Uni-Directional graphite rod.

4: Acer Saccharum (Hard Maple) or Swietenia Macrophylla (Mahogany) with a specific gravity not less than 0.36 and maximum grain slope of one in 15 and at least six annular rings per inch.

5: 3M ScotchWeld™ 2216 B/A structural adhesive.

6: Gougeon Brothers/West System™ 105–206 Slow laminating resin.

Note:

Carbon fiber/graphite, adhesives, and resins may be of different brand as long as they are of the same grade and quality and a directly acceptable equivalent replacement.

What is claimed is:

1. A high strength stringed musical instrument neck, which is constructed so that the tension from a plurality of strings acting upon it in singular plane is controlled and redirected by a monocoque outer structure as an opposing force to the tension imposed by the plurality of strings, and improved method of construction comprising a length of hardwood shaped as the instruments neck; and two separate strengthening beams made from graphite and epoxy resins and, adhesively securing said beams to and within the wood; and one external strengthening shell made from carbon cloth and epoxy resins, and adhesively securing said shell to the wood and both beams inclusive; and a fingerboard adhesively secured, and a two way truss rod assembly made from stainless steel being adjustable to facilitate up bow and back bow relative to the playing surface.

2. A high strength stringed musical instrument neck as recited in claim one wherein both strengthening beams are made from graphite in epoxy resins and one of which is in the form of a flat plate and the other is in the form of a rectangular rod and each having a generally flat bottom and top surface.

3. A high strength stringed musical instrument neck as recited in claim one wherein the external strengthening shell is made from a plurality of layers of carbon fiber cloth cast in epoxy resins and formed upon a mold and the weave of said cloth is disposed at an angle of 45° to the longitudinal axis of said mold to form an external truss structure and having a semi-elliptical cross sectional shape.

4. A high strength stringed musical instrument neck comprising the steps of:

providing a structural length of hardwood shaped as the instruments neck; and providing two graphite strengthening beams; and machining the length of hard wood to accept the installation of said beams; and adhesively securing said beams; and providing an external carbon fiber strengthening outer shell; and adhesively securing said shell to the wood and both beams inclusive; and providing a stainless steel two way truss rod assembly within the wood core, and providing a fingerboard and adhesively securing it to the neck.

* * * * *